US011266291B1

(12) United States Patent
Gross et al.

(10) Patent No.: US 11,266,291 B1
(45) Date of Patent: Mar. 8, 2022

(54) DISHWASHER APPLIANCE WITH A SIDEFIRE LED LIGHTGUIDE

(71) Applicant: Haier US Appliance Solutions, Inc., Wilmington, DE (US)

(72) Inventors: Michelle Diana Gross, Louisville, KY (US); Kyle James Brewer, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/115,370

(22) Filed: Dec. 8, 2020

(51) Int. Cl.
*A47L 15/42* (2006.01)
*F21V 33/00* (2006.01)
*F21Y 115/10* (2016.01)

(52) U.S. Cl.
CPC ..... *A47L 15/4293* (2013.01); *F21V 33/0044* (2013.01); *A47L 2301/04* (2013.01); *A47L 2501/26* (2013.01); *F21V 2200/00* (2015.01); *F21Y 2115/10* (2016.08)

(58) Field of Classification Search
CPC ..... A47L 15/4293; A47L 2301/04; A47L 2501/26; A47L 9/30; F21V 33/0044; F21V 2200/00; F21Y 2115/10; F21W 2131/403; H05K 2217/96042
See application file for complete search history.

(56) References Cited

U.S. PATENT DOCUMENTS

| | | | | |
|---|---|---|---|---|
| 9,179,554 | B2 * | 11/2015 | Schuh | H05K 3/30 |
| 10,687,686 | B2 | 6/2020 | Brewer et al. | |
| 10,731,918 | B1 | 8/2020 | Patel et al. | |
| 2020/0049401 | A1 * | 2/2020 | Staud | F24C 7/085 |
| 2020/0129040 | A1 | 4/2020 | Brewer | |

FOREIGN PATENT DOCUMENTS

| | | | |
|---|---|---|---|
| DE | 3621438 | A1 | 3/1988 |
| EP | 3287063 | A1 | 2/2018 |
| JP | 4786992 | B2 | 10/2011 |

* cited by examiner

*Primary Examiner* — Peggy A Neils
(74) *Attorney, Agent, or Firm* — Dority & Manning, P.A.

(57) ABSTRACT

A dishwasher appliance includes a user interface panel positioned on a door at a top edge of the door. A circuit board is positioned within the door. A user touch input and a side-fire light emitting diode are mounted to the circuit board. A lightguide is positioned within the door. An inlet of the lightguide is positioned proximate the side-fire light emitting diode, and an outlet of the lightguide positioned below the circuit board. The side-fire light emitting diode is operable to emit light, and the lightguide is configured such that the light from the side-fire light emitting diode is reflected within the lightguide from the inlet of the lightguide to the outlet of the lightguide in order to illuminate an indicator at the outlet of the lightguide with the light from the side-fire light emitting diode.

20 Claims, 6 Drawing Sheets

DISHWASHER APPLIANCE WITH A SIDEFIRE LED LIGHTGUIDE

FIELD OF THE INVENTION

The present subject matter relates generally to dishwasher appliances with user inputs and indicators.

BACKGROUND OF THE INVENTION

Top control dishwasher appliances include a control panel integrated into a top of the dishwasher's door. The control panel may be hidden when the door is closed. Thus, top control dishwasher appliances may provide a sleek appearance relative to front control dishwasher appliances that include a control panel that faces forward when the door is closed.

The sleek appearance of top control dishwasher appliances can have drawbacks. For example, the control panel frequently displays an operational status while the dishwasher appliance is operating, and a user can have difficulty viewing the control panel on top control dishwasher appliances when the door is closed and the dishwasher is operating. Thus, it can be difficult for the user to determine the current operational status of top control dishwasher appliances while the door is closed and the control panel is hidden.

Known top control dishwasher appliances include front indication that is operable to present the current operational status on a front panel. Thus, the user can more easily determine the current operational status via the front indication. However, wiring and mounting the front indication within the door can be difficult.

BRIEF DESCRIPTION OF THE INVENTION

Aspects and advantages of the invention will be set forth in part in the following description, or may be apparent from the description, or may be learned through practice of the invention.

In a first example embodiment, a dishwasher appliance includes a cabinet defining a wash chamber. A door is mounted to the cabinet such that the door is openable and closable to selectively seal the wash chamber. A user interface panel is positioned on the door at a top edge of the door. A circuit board is positioned within the door below the user interface panel. A user touch input is mounted to the circuit board. The user touch input is operable to detect a user input on the user interface panel. A side-fire light emitting diode is mounted to the circuit board. A lightguide is positioned within the door. An inlet of the lightguide is positioned proximate the side-fire light emitting diode. An outlet of the lightguide is positioned below the circuit board. The side-fire light emitting diode is operable to emit light, and the lightguide is configured such that the light from the side-fire light emitting diode is reflected within the lightguide from the inlet of the lightguide to the outlet of the lightguide in order to illuminate an indicator at the outlet of the lightguide with the light from the side-fire light emitting diode.

In a second example embodiment, a dishwasher appliance includes a cabinet defining a wash chamber. A door is hinged to the cabinet adjacent a bottom edge of the door such that the door is openable and closable to selectively seal the wash chamber. A user interface panel is positioned on the door at a top edge of the door. A circuit board is positioned within the door and mounted to the user interface panel. A user touch input is mounted to the circuit board. The user touch input is operable to detect a user input on the user interface panel. The user touch panel is one of a touch sensor and a tactile switch. A side-fire light emitting diode is mounted to the circuit board. A lightguide is positioned within the door. An inlet of the lightguide positioned proximate the side-fire light emitting diode, and an outlet of the lightguide positioned below the circuit board. The side-fire light emitting diode is operable to emit light, and the lightguide is configured such that the light from the side-fire light emitting diode is reflected within the lightguide from the inlet of the lightguide to the outlet of the lightguide in order to illuminate an indicator at the outlet of the lightguide with the light from the side-fire light emitting diode.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
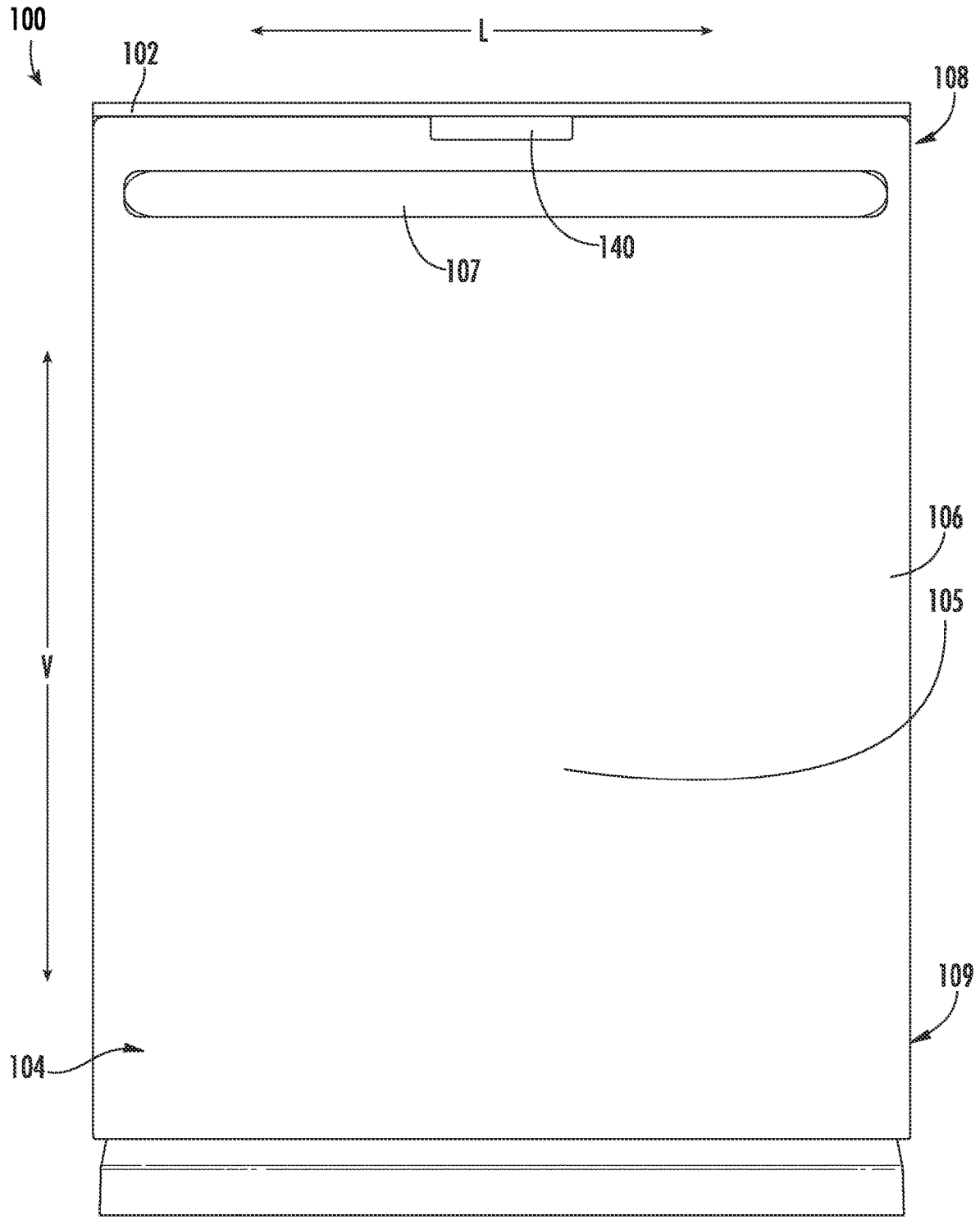
FIG. 1 is a front elevation view of a dishwasher appliance according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 depicts an example domestic dishwasher appliance 100 that may be configured in accordance with aspects of the present disclosure. It should be appreciated that the invention is not limited to any particular style, model, or other configuration of dishwasher, and that the embodiment depicted in FIG. 1 is for illustrative purposes only.

Dishwasher appliance 100 includes a tub 102 that defines a wash chamber 104 within an interior of tub 102. Wash chamber 104 is configured for the receipt of articles for cleaning, such as dishes, cups, utensils, etc. Tub 102 includes a front opening (not shown) and a door 106 with a handle 107. Door 106 extends between a top portion 108 and a bottom portion 109 along a vertical direction V, and door 106 is hinged at or near bottom portion 109 of door 106 for movement between a normally closed vertical position (shown in FIG. 1), wherein wash chamber 104 is sealed shut for washing operation, and a horizontal open position for loading and unloading of articles from wash chamber 104.

Dishwasher appliance 100 includes various components for applying wash fluid onto articles within wash chamber 104 and for supporting the articles within wash chamber 104. Such components are well known in the art and not shown or described in detail herein. As an example, dishwasher appliance 100 may include racks for supporting articles for washing within wash chamber 104, spray assemblies for directing flows of wash fluid onto the articles within the racks, silverware baskets, etc. The racks may be adapted for movement between an extended loading position in which the racks are substantially positioned outside wash chamber 104, and a retracted position in which the racks are located inside wash chamber 104. The spray assemblies may include rotatable spray arms mounted to tub 102 and/or one or the racks.

In general, dishwasher appliance 100 may utilize a variety of cycles to wash and, optionally, dry articles within wash chamber 104. For example, a wet cycle is utilized to wash articles. The wet cycle may include a main wash cycle and a rinse cycle, as well as an optional pre-wash cycle. During each such cycle, water or another suitable liquid may be utilized in wash chamber 104 to interact with and clean articles therein. The liquid may additionally mix with, for example, detergent or other various additives which are released into the chamber during various sub-cycles of the wet cycle. A drying cycle may be utilized to dry articles after washing. In generally, no liquid is sprayed or otherwise produced during the drying cycle. During the drying cycle, liquid water on the articles within wash chamber 104 evaporates.

Figure 2:
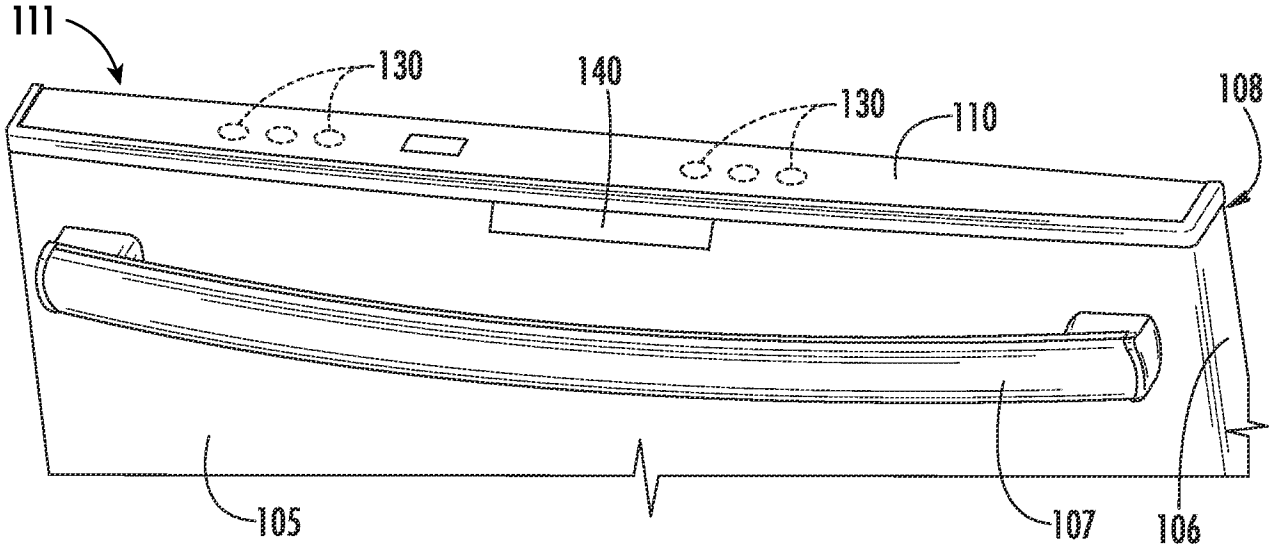
FIG. 2 is a partial perspective view of a door of the example dishwasher appliance of FIG. 1.
Figure 3:
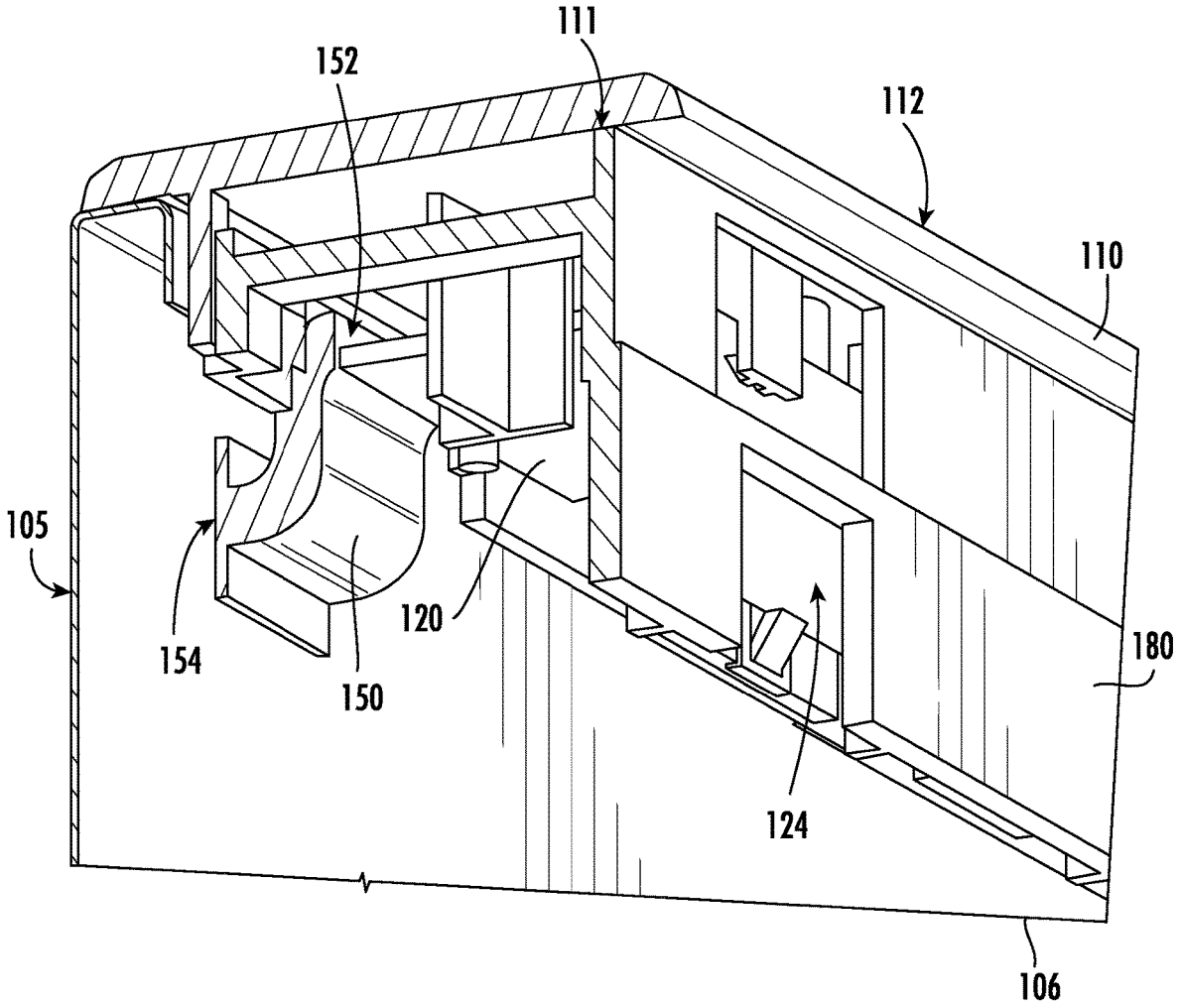
FIG. 3 is a partial section view of the door of the example dishwasher appliance of FIG. 1.
Figure 4:
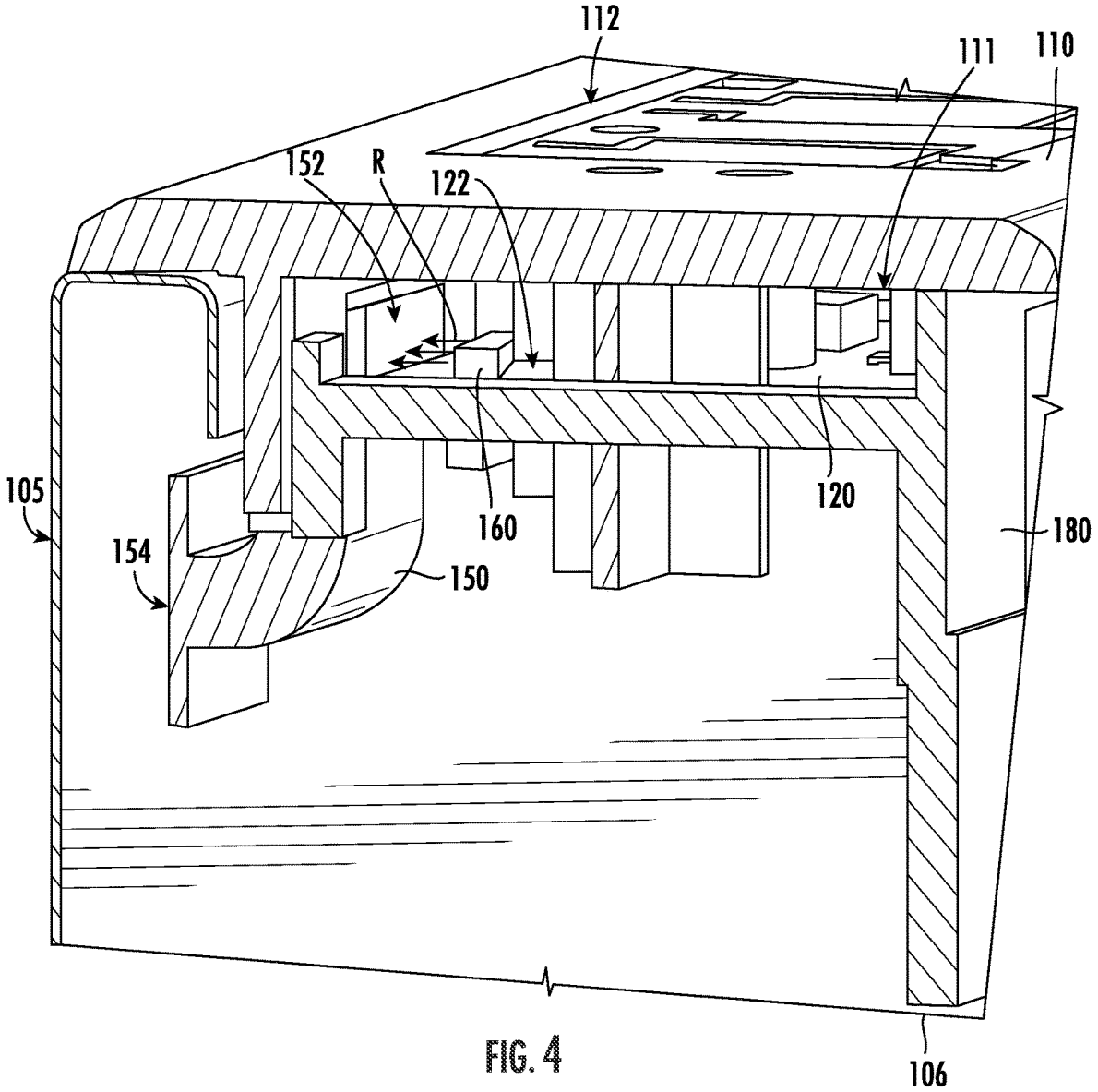
FIG. 4 is another partial section view of the door of the example dishwasher appliance of FIG. 1.
Figure 5:
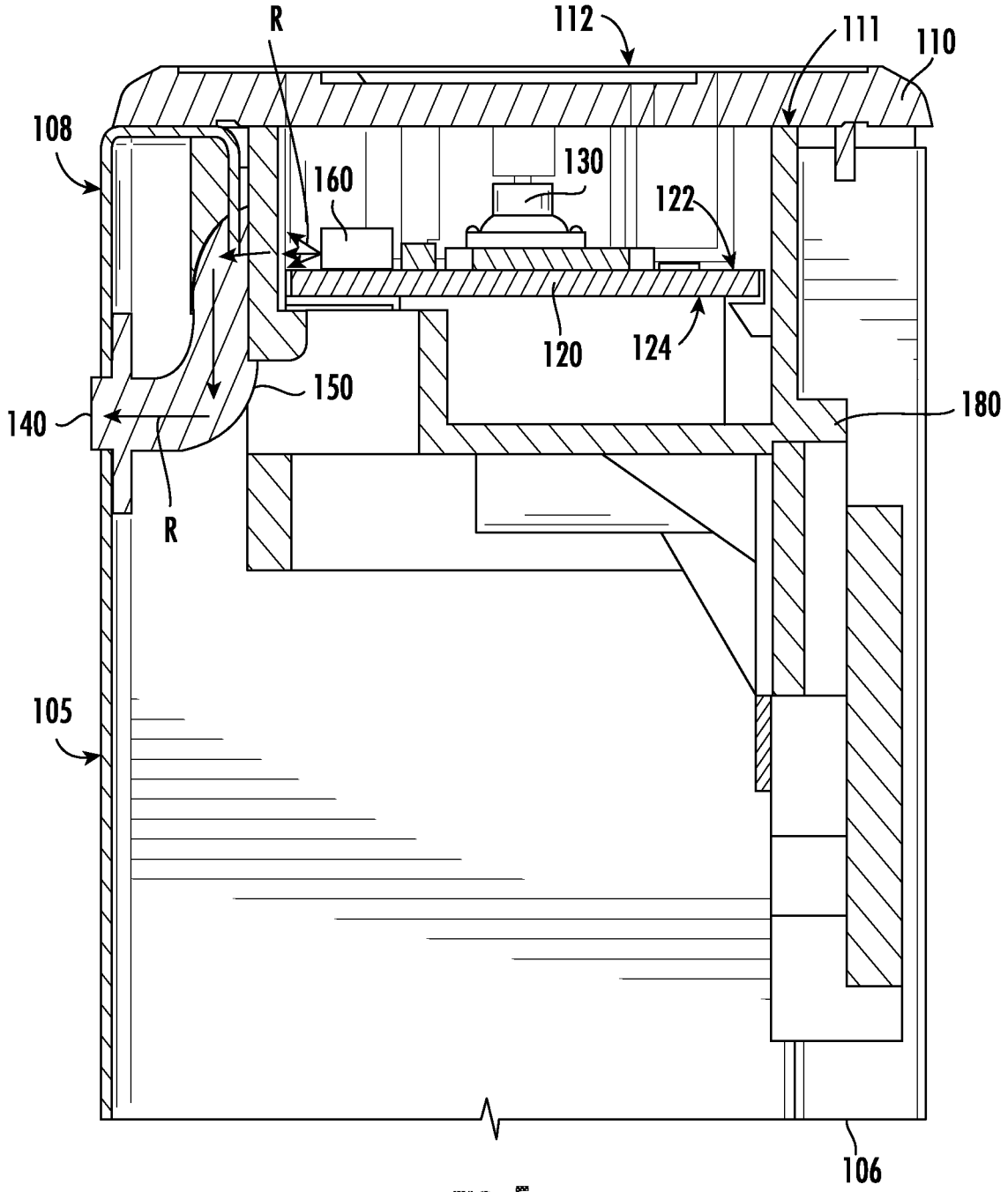
FIG. 5 is a side, partial elevation view of the door of the example dishwasher appliance of FIG. 1.

FIG. 2 is a partial perspective view of door 106. FIGS. 3 through 5 are partial section views of door 106. With reference to FIGS. 2 through 5, dishwasher appliance 100 includes a user interface panel 110. User interface panel 110 is positioned on door 106, e.g., at a top edge 111 of door 106. Thus, e.g., user interface panel 110 may be hidden below a countertop when dishwasher appliance 100 is installed below the countertop and door 106 is closed. Accordingly, dishwasher appliance 100 may be referred to as a "top control dishwasher appliance." In certain example embodiments, user interface panel 110 may be constructed of or with a dielectric material, such as glass or plastic, e.g., when underlying user touch inputs 130 are capacitive touch sensors.

User interface panel 110 is also positioned on door 106 such that a user can engage, e.g., touch, user interface panel 110. Thus, the user can activate/deactivate various cycles of dishwasher appliance 100 using user interface panel 110. In particular, dishwasher appliance 100 includes a circuit board 120 and a plurality of user touch inputs 130 (FIGS. 2 and 5). Circuit board 120 may be a printed circuit board and be positioned within door 106 below user interface panel 110. User touch inputs 130 are mounted to circuit board 120, and user touch inputs 130 are operable to detect user inputs on user interface panel 110. For example, user touch inputs 130 may be touch sensors configured for triggering when a user touches a top surface 112 of user interface panel 110. In certain example embodiments, user touch inputs 130 may be capacitive sensors that detect when a finger or another conductive material with a dielectric different than air contacts or approaches user interface panel 110. When a user touches top surface 112 of user interface panel 110 adjacent one of user touch inputs 130, such user touch input 130 triggers and, e.g., signals a controller (not shown). In such a manner, operations of dishwasher appliance 100 can be initiated and controlled. In alternative example embodiments, user touch inputs 130 may be tactile switches, other suitable touch inputs, or combinations of user touch inputs. User touch inputs 130 may be distributed laterally on circuit board 120 below user interface panel 110. Thus, while only one of user touch inputs 130 is shown in FIG. 5, it will be understood that other user touch inputs 130 are positioned behind the user touch input 130 shown in FIG. 5.

The controller regulates operation of dishwasher appliance 100. Thus, the controller is in operative communication with various components of dishwasher appliance 100, such as a pump, a temperature sensor, a fill sensor, a turbidity sensor, etc. The controller includes memory and one or more processing devices such as microprocessors, CPUs or the like, such as general or special purpose microprocessors operable to execute programming instructions or micro-control code associated with operation of dishwasher appliance 100. The memory can represent random access memory such as DRAM, or read only memory such as ROM or FLASH. The processor executes programming instructions stored in the memory. The memory can be a separate component from the processor or can be included onboard within the processor. Alternatively, the controller may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Circuit board 120 may be positioned generally parallel to user interface panel 110 within door 106. In particular, both user interface panel 110 and circuit board 120 may be oriented horizontally when door 106 is closed. As used herein, the term "generally" means within ten degrees of the stated angle when used in the context of board orientations.

A bracket 180 may be positioned within door 106. Bracket 180 may be constructed of or with injection molded plastic or another suitable material. User interface panel 110 and circuit board 120 may be mounted to bracket 180 within door 106. Thus, user interface panel 110 and circuit board 120 may be mounted to a common structure within door 106 in order to assist with arranging user interface panel 110 and circuit board 120 in the generally parallel configuration. User interface panel 110 and circuit board 120 may be mounted to bracket 180 in any suitable manner, e.g., with fasteners or snap-fit interfaces. As noted above, circuit board 120 may also be mounted to user interface panel 110, e.g., rather than bracket 180.

Dishwasher appliance 100 also includes a user indicator 140 and a plurality of side-fire light emitting diodes (LEDs) 160. Side-fire LEDs 160 may be distributed laterally on circuit board 120 below user interface panel 110. Thus, while only one of side-fire LEDs 160 is shown in FIGS. 4 and 5, it will be understood that other side-fire LEDs 160 are positioned behind the user touch input 130 shown in FIG. 5.

User indicator 140 is positioned on door 106 below the user interface panel 110. In particular, user indicator 140 may be positioned at a front face 105 of door 106. The front face 105 of door 106 may face towards a user of dishwasher appliance 100 when door 106 is closed and may thus correspond to the outermost or visible panel of door 106. Front face 105 of door 106 may be constructed of stainless steel, painted steel, etc. in order to have a pleasant cosmetic appearance. User indicator 140 may be constructed of or with a transparent or translucent material with a film or printing that forms symbols, words, shapes, colors, etc. that are visible from front face 105 of door 106 when illuminated by side-fire LEDs 160 within door 106. Thus, user indicator 140 may show one or more operational indicators on user indicator 140 to a user looking at door 106 when one or more operational indicators on user indicator 140 are illuminated by side-fire LEDs 160 within door 106. In contrast, user indicator 140 may be dead fronted when side-fire LEDs 160 are deactivated and not illuminating operational indicators on user indicator 140.

Side-fire LEDs 160 are mounted to circuit board 120, and side-fire LEDs 160 are operable to illuminate indicators on user indicator 140. In particular, side-fire LEDs 160 are operable to direct light R (FIG. 3) from within door 106 towards and/or through a lightguide 150 to user indicator 140. Side-fire LEDs 160 may be positioned on circuit board 120 to emit light R, e.g., such that light R is substantially perpendicular to a line that is normal to a top surface 122 or a bottom surface 124 of circuit board 120.

Lightguide 150 is positioned within door 106. Lightguide 150 includes an inlet 152 and an outlet 154 that are spaced apart from each other. For instance, inlet 152 of lightguide 150 may be positioned proximate one or more of side-fire LEDs 160. Conversely, outlet 154 of lightguide 150 may be positioned below circuit board 120. Lightguide 150 is configured for directing light R from side-fire LED 160 to user indicator 140 in order to illuminate user indicator 140 with the light R from side-fire LED 160. Moreover, lightguide 150 may be configured such that light R from side-fire LED 160 is reflected within lightguide 150 from inlet 152 of lightguide 150 to outlet 154 of lightguide 150.

As shown in FIGS. 3 through 5, lightguide 150 may be formed as a light pipe such that lightguide 150 is configured for total internal reflection of light R from side-fire LED 160 to user indicator 140. Thus, e.g., light guide 150 may be constructed of or with a transparent or translucent material, such as a glass or plastic. The light R from side-fire LED 160 may reflect off the interface between lightguide 150 and ambient air around lightguide 150.

Lightguide 150 may be curved between inlet 152 and outlet 154 of lightguide 150. For instance, lightguide 150 may be S-shaped between inlet 152 and outlet 154 of lightguide 150, e.g., in a plane that is perpendicular to horizontal, as shown in FIGS. 3 through 5. As another example, lightguide 150 may include two (2) ninety-degree (90°) curves between inlet 152 and outlet 154 of lightguide 150, and inlet and outlet 152, 154 of lightguide 150 may face opposite directions and/or be located in different vertical planes. Inlet 152 of lightguide 150 may be positioned above outlet 154 of lightguide 150. For instance, side-fire LED(s) 160 may be mounted to and positioned at top surface 122 of circuit board 120. Similarly, user touch inputs 130 may also be mounted to and positioned at top surface 122 of circuit board 120. Inlet 152 of lightguide 150 may be positioned above top surface 122 of circuit board 120, e.g., such that inlet 152 of lightguide 150 is aligned with side-fire LED 160 in order to receive light R from side-fire LED 160. Conversely, outlet 154 of lightguide 150 may be positioned below top surface 122 of circuit board 120. Accordingly, circuit board 120 may be positioned vertically between inlet 152 and outlet 154 of lightguide 150, and lightguide 150 may extend vertically past circuit board 120 from inlet 152 to outlet 154 of lightguide 150.

It will be understood that side-fire LED(s) 160 may be mounted to and positioned at bottom surface 124 of circuit board 120, in alternative example embodiments. Thus, e.g., lightguide 150 may be shifted downwardly, e.g., along the vertical direction V, within door 106. Moreover, inlet and outlet 152, 154 of lightguide 150 may be shifted to lower vertical planes within door 106.

As noted above, lightguide 150 may be formed as a light pipe such that lightguide 150 transfers from light R from side-fire LED 160 that enters lightguide 150 at inlet 152 to user indicator 140 at outlet 154 of lightguide 150 via total internal reflection within lightguide 150. Thus, e.g., lightguide 150 may include a continuous piece of plastic or glass between inlet and outlet 152, 154 of lightguide 150. The continuous piece of plastic or glass that forms lightguide 150 may be curved (e.g., S-shaped) between inlet 152 and outlet 154 of lightguide 150, and the continuous piece of plastic or glass may internally reflect the light R from side-fire LED 160 at an interface between lightguide 150 and ambient air around lightguide 150.

In certain example embodiments, user indicator 140 is formed by lightguide 150, e.g., at outlet of lightguide 150. For instance, the user indicator 140 may be at least partially formed at outlet 154 of lightguide 150, e.g., with or of the continuous piece of plastic or glass of lightguide 150. Moreover, user indicator 140 may be formed with a film or printing on the continuous piece of plastic or glass of lightguide 150 at outlet 154 that forms symbols, words, shapes, colors, etc. that are visible from front face 105 of door 106 when illuminated by side-fire LEDs 160 within door 106.

As may be seen from the above, dishwasher appliance 100 may include a single, common circuit board for both user touch inputs 130 and side-fire LEDs 160. Thus, dishwasher appliance 100 may not include separate circuit boards for user touch inputs 130 and side-fire LEDs 160. Moreover, user touch inputs 130 and side-fire LEDs 160 may both be mounted to and positioned at one side of circuit board 120, e.g., at top surface 122. Thus, dishwasher appliance 100 may not require forming circuit board 120 with user touch inputs 130 and side-fire LEDs 160 on opposite sides of circuit board 120. Accordingly, user interface panel 110 may be formed with only one circuit board 120. In addition, dishwasher appliance 100 may include a side-fire light emitting diode 160 mounted to top surface 122 of circuit board 120, with the side-fire light emitting diode 160 oriented to emit light R towards front face 105 of door 106, e.g., above user indicator 140. Inlet 152 of lightguide 150 may be oriented perpendicular to emitted light R from side-fire light emitting diode 160 and/or parallel to front face 105 of door 106. From inlet 152, lightguide 150 may curve downwardly and towards front face 105 of door 106, and the light R from side-fire light emitting diode 160 may exit lightguide 150 at outlet 154 to illuminate user indicator 140. Thus, lightguide 150 may be shaped to guide light R from side-fire light emitting diode 160 to a different vertical plane within door 106.

Figure 6:
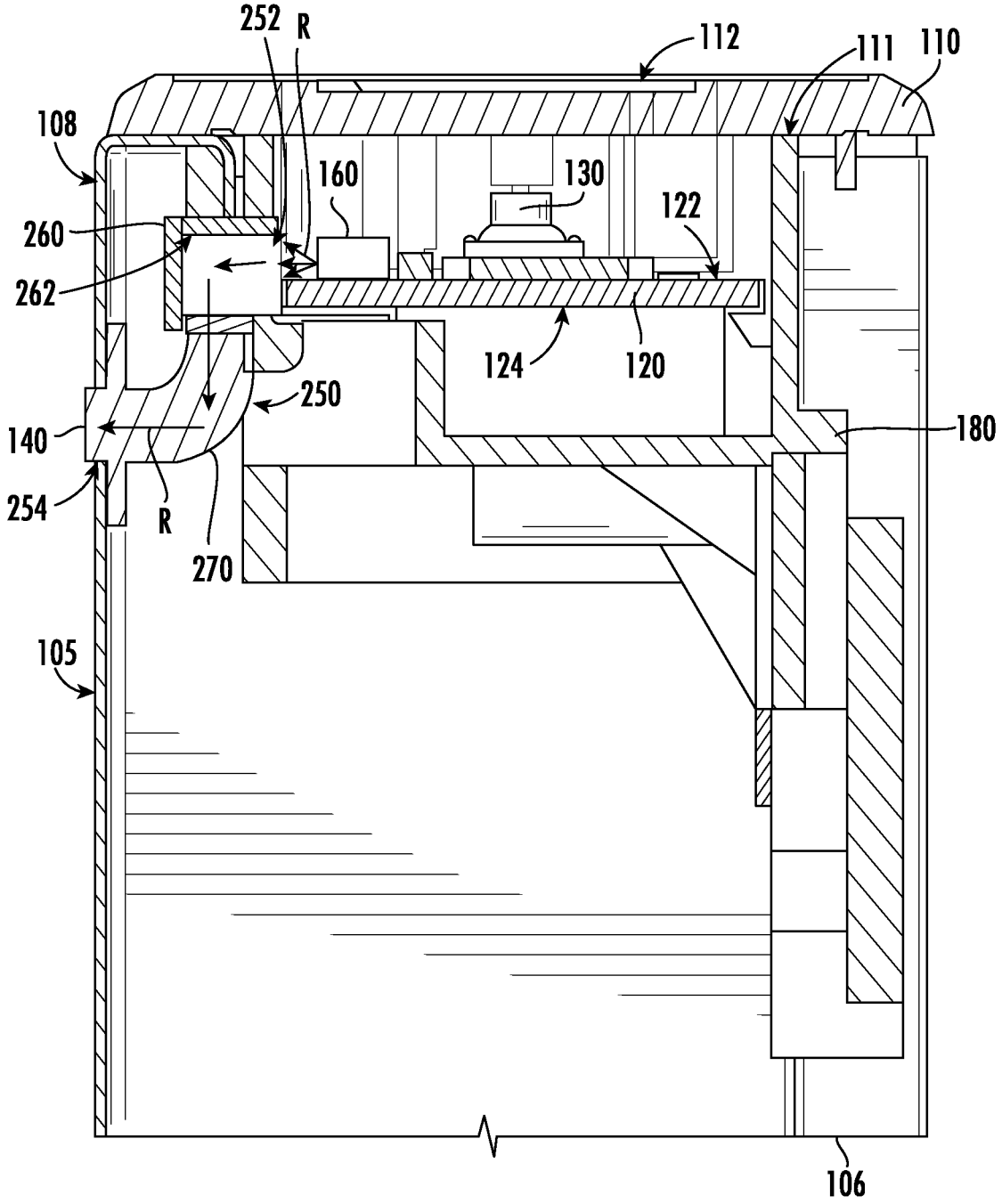
FIG. 6 is a side, partial elevation view of a door of an example dishwasher appliance according to another example embodiment of the present subject matter.

FIG. 6 is a section view of door 106 with a lightguide 250 according to another example embodiment. Lightguide 250 includes similar features and operates in a similar manner to lightguide 150. Thus, the description of lightguide 150 provided above is applicable to lightguide 250, except as expressly noted. As shown in FIG. 6, lightguide 250 includes a casing 260 with a reflective inner surface 262 and a continuous piece of plastic 270. Casing 260 with reflective inner surface 262 is positioned proximate and forms inlet 252 of lightguide 250, and continuous piece of plastic 270 is positioned proximate and forms outlet 254 of lightguide 250. Reflective inner surface 262 of casing 260 is oriented for reflecting the light R from side-fire LED 160 about ninety degrees (90°), e.g., such that the light R from side-fire LED 160 is directly downwardly. As used herein, the term "about" means within ten degrees of the stated angle when used in the context of light reflection angles. Continuous piece of plastic 270 is curved and internally reflects the light from reflective inner surface 262 of casing 270 to outlet 254 of lightguide 250. As may be seen from the above, casing 260 may form a light tunnel, such as a ninety-degree) (90° light tunnel, and continuous piece of plastic 270 may form a light pipe, such as a ninety-degree (90°) light pipe. The light tunnel formed by casing 260 and the light pipe formed by continuous piece of plastic 270 cooperate to direct light R from side-fire LED 160 to user indicator 140, e.g., in a similar manner to that described above for lightguide 150. Casing 260 may be a portion of bracket 180, in certain example embodiments.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance, comprising:

a cabinet defining a wash chamber;

a door mounted to the cabinet such that the door is openable and closable to selectively seal the wash chamber;

a user interface panel positioned on the door at a top edge of the door;

a circuit board positioned within the door below the user interface panel;

a user touch input mounted to the circuit board, the user touch input operable to detect a user input on the user interface panel;

a side-fire light emitting diode mounted to the circuit board;

a lightguide positioned within the door, an inlet of the lightguide positioned proximate the side-fire light emitting diode, an outlet of the lightguide positioned below the circuit board; and wherein the side-fire light emitting diode is operable to emit light, and the lightguide is configured such that the light from the side-fire light emitting diode is reflected within the lightguide from the inlet of the lightguide to the outlet of the lightguide in order to illuminate an indicator at the outlet of the lightguide with the light from the side-fire light emitting diode.

2. The dishwasher appliance of claim 1, the circuit board is mounted to the user interface panel.

3. The dishwasher appliance of claim 2, wherein the circuit board is snap-fit to the user interface panel, and the circuit board is oriented parallel to the user interface panel.

4. The dishwasher appliance of claim 1, wherein the lightguide is curved between the inlet and the outlet of the lightguide.

5. The dishwasher appliance of claim 1, wherein the inlet of the lightguide is positioned above the outlet of the lightguide.

6. The dishwasher appliance of claim 5, wherein the side-fire light emitting diode is positioned at a top surface of the circuit board, the inlet of the lightguide is positioned above the top surface of the circuit board, and the outlet of the lightguide is positioned below the top surface of the circuit board.

7. The dishwasher appliance of claim 6, wherein the lightguide comprises a continuous piece of plastic between the inlet and the outlet of the lightguide, the continuous piece of plastic is curved between the inlet and the outlet of the lightguide, and the continuous piece of plastic internally reflects the light from the side-fire light emitting diode from the inlet of the lightguide to the outlet of the lightguide.

8. The dishwasher appliance of claim 7, wherein the continuous piece of plastic is S-shaped between the inlet and the outlet of the lightguide.

9. The dishwasher appliance of claim 6, wherein the lightguide comprises a casing with a reflective inner surface and a continuous piece of plastic, the casing with the reflective inner surface is positioned proximate and forms the inlet of the lightguide, and the continuous piece of plastic is positioned proximate and forms the outlet of the lightguide.

10. The dishwasher appliance of claim 9, wherein the reflective inner surface of the casing is oriented for reflecting the light from the side-fire light emitting diode about ninety degrees, and the continuous piece of plastic is curved and internally reflects the light from the reflective inner surface of the casing to the outlet of the lightguide.

11. The dishwasher appliance of claim 1, wherein the lightguide comprises a transparent or translucent panel with a film or printing that forms the indicator at the outlet of the lightguide, the indicator comprising a respective one or more symbols, words, shapes, and colors visible from a front face of the door when illuminated by the light from the side-fire light emitting diode.

12. A dishwasher appliance, comprising:

a cabinet defining a wash chamber;

a door hinged to the cabinet adjacent a bottom edge of the door such that the door is openable and closable to selectively seal the wash chamber;

a user interface panel positioned on the door at a top edge of the door;

a circuit board positioned within the door and mounted to the user interface panel;

a user touch input mounted to the circuit board, the user touch input operable to detect a user input on the user interface panel, the user input being one of a touch sensor and a tactile switch;

a side-fire light emitting diode mounted to the circuit board;

a lightguide positioned within the door, an inlet of the lightguide positioned proximate the side-fire light emitting diode, an outlet of the lightguide positioned below the circuit board; and wherein the side-fire light emitting diode is operable to emit light, and the lightguide is configured such that the light from the side-fire light emitting diode is reflected within the lightguide from the inlet of the lightguide to the outlet of the lightguide in order to illuminate an indicator at the outlet of the lightguide with the light from the side-fire light emitting diode.

13. The dishwasher appliance of claim 12, wherein the circuit board is snap-fit to the user interface panel, and the circuit board is oriented parallel to the user interface panel.

14. The dishwasher appliance of claim 12, wherein the inlet of the lightguide is positioned above the outlet of the lightguide.

15. The dishwasher appliance of claim 14, wherein the side-fire light emitting diode is positioned at a top surface of the circuit board, the inlet of the lightguide is positioned above the top surface of the circuit board, and the outlet of the lightguide is positioned below the top surface of the circuit board.

16. The dishwasher appliance of claim 15, wherein the lightguide comprises a continuous piece of plastic between the inlet and the outlet of the lightguide, the continuous piece of plastic is curved between the inlet and the outlet of the lightguide, and the continuous piece of plastic internally reflects the light from the side-fire light emitting diode from the inlet of the lightguide to the outlet of the lightguide.

17. The dishwasher appliance of claim 16, wherein the continuous piece of plastic is S-shaped between the inlet and the outlet of the lightguide.

18. The dishwasher appliance of claim 15, wherein the lightguide comprises a casing with a reflective inner surface and a continuous piece of plastic, the casing with the reflective inner surface is positioned proximate and forms the inlet of the lightguide, and the continuous piece of plastic is positioned proximate and forms the outlet of the lightguide.

19. The dishwasher appliance of claim 18, wherein the reflective inner surface of the casing is oriented for reflecting the light from the side-fire light emitting diode about ninety degrees, and the continuous piece of plastic is curved and internally reflects the light from the reflective inner surface of the casing to the outlet of the lightguide.

20. The dishwasher appliance of claim 12, wherein the lightguide comprises a transparent or translucent panel with a film or printing that forms the indicator at the outlet of the lightguide, the indicator comprising a respective one or more symbols, words, shapes, and colors visible from a front face of the door when illuminated by the light from the side-fire light emitting diode.

* * * * *